United States Patent [19]

Kawaguchi et al.

[11] 4,413,791

[45] Nov. 8, 1983

[54] GLASS FIBER STRAND WINDING APPARATUS

[75] Inventors: Yutaka Kawaguchi; Michio Sato; Shin Kasai, all of Fukushima, Japan

[73] Assignee: Nitto Boseki Co., Ltd., Fukushima, Japan

[21] Appl. No.: 369,978

[22] Filed: Apr. 19, 1982

[30] Foreign Application Priority Data

Apr. 22, 1981 [JP] Japan ..... 56/60774

[51] Int. Cl.[3] ..... B65H 54/02; B65H 67/04; B65H 75/28

[52] U.S. Cl. ..... 242/18 G; 242/18 A; 242/18 PW

[58] Field of Search ..... 242/18 G, 18 PW, 18 A, 242/25 A

[56] References Cited

U.S. PATENT DOCUMENTS

| | | | |
|---|---|---|---|
| 2,481,031 | 9/1949 | McDermott | 242/18 PW |
| 3,149,795 | 9/1964 | Rhein, Jr. | 242/18 A |
| 3,198,445 | 8/1965 | Hull, Jr. et al. | 242/18 PW |
| 3,298,621 | 1/1967 | McCoy | 242/18 A |
| 3,583,650 | 6/1971 | Zaborovsky | 242/18 A |
| 3,801,038 | 4/1974 | Wust | 242/18 A X |
| 4,046,329 | 9/1977 | Eisenberg et al. | 242/18 G |
| 4,054,249 | 10/1977 | Klink et al. | 242/18 G |
| 4,069,984 | 1/1978 | Klink et al. | 242/18 G |
| 4,106,711 | 8/1978 | Oswald et al. | 242/18 A X |
| 4,307,849 | 12/1981 | Jones et al. | 242/18 G |

*Primary Examiner*—Stanley N. Gilreath
*Attorney, Agent, or Firm*—Charles A. Blank

[57] ABSTRACT

An apparatus for winding a strand of glass fibers drawn from a bushing, having a rotatable turret and at least two winding collets mounted on the turret and adapted to be brought into a winding position one by one upon rotation of the turret. Each winding collet is provided at its free end with a waste strand winding portion having a frusto-conical strand guide surface coaxially extending with the collet and converged towards its free end, an annular strand stopping wall radially outwardly extending from the free end of the frusto-conical guide surface, at least one crescent-shaped wall surface extending radially inwardly from a portion of the outer periphery at the free end of the guide surface and formed thereon with a plurality of parallel grooves extending at a right angle to the diameter of the guide surface, and a crescent-shaped flat portion extending from a portion of the outer periphery of the stopping wall in confronting spaced relationship with the crescent-shaped wall surface. Upon the transferring of the strand from the full collet to the empty collet, when the strand is brought onto the frusto-conical guide surface, it is moved along the guide surface toward its free end, then slipped down along the crescent-shaped flat portion and finally caught by one of parallel grooves. The strand thus caught is automatically cut at a point in contact with the edge of the groove during subsequent rotation of both of the full and the empty collets.

5 Claims, 11 Drawing Figures

GLASS FIBER STRAND WINDING APPARATUS

BACKGROUND OF THE INVENTION

The present invention relates to an apparatus for winding a strand or strands of glass fibers and, more particularly, to an improvement in the construction of the waste strand winding portion of an winding collet.

In the production of a strand of glass fibers, a multiplicity of filaments are drawn from a bushing and, after being coated with a lubricant size, the filaments are gathered into one or more strands which are then wound around a winding tube through a traversing motion to be directly formed into a package by means of a strand winding apparatus. A typical known winding apparatus for winding the strand of glass fibers has a pair of winding collets mounted on a rotatable turret so as to diametrically oppose to each other. In operation, one of these collets is stationed at the winding position and, when the winding tube of this collet has become full, the turret is rotated 180° to bring the other collet having empty winding tube into the winding position so that the strand is transferred from the full winding tube to the empty tube thereby to permit a continuous winding without any suspension of the work.

The U.S. Pat. No. 4,046,329 discloses a winding apparatus of the type described in which after the strand is transferred from the full winding tube to the empty tube, the portion of the strand bridged between the both winding tubes is automatically cut due to an increase of its tension which is naturally resulted from continuous rotation of the both winding collets after interchanging their positions. In this apparatus, the waste strand winding portion provided at the free end of each winding collet is coaxially formed with a frusto-conical strand guide surface and provided with a fixed member such as pin, hook, guide plate or the like which is arranged to project towards the portion of the guide surface adjacent to the small-diameter end thereof. In transfer operation, the strand brought into contact with the waste strand winding portion of the collet carrying the empty winding tube is moved along the frusto-conical guide surface towards the small-diameter end thereof owing to the winding tension and, just before reaching the small-diameter end, it is caught by the fixed member. As the both collets are rotated continuously, the tension of the strand caught by the fixed member is gradually increased and finally the strand is cut at a point at which the strand is hooked by the edge of the fixed member. In this apparatus, since the trapping and cutting of the strand by the fixed member is concentrated to one point of the strand, the trapping of the strand is often failed. This problem is enhanced particularly when the apparatus is used with a strand consisting of filaments of a small diameter and subjected to a large winding tension. In addition, since the fixed member is repeatedly frictioned by the strand, it is worn down rapidly and the lubricant size adhered to the strand tends to be accumulated in the area around the fixed member. In order to maintain the apparatus in good order, it is necessary to suspend the operation of the winding apparatus frequently for cleaning the apparatus.

SUMMARY OF THE INVENTION

Accordingly, an object of the invention is to provide a glass fiber strand winding apparatus in which the strand is automatically cut in the same manner as the prior art shown in the specification of the U.S. Pat. No. 4,046,329, wherein the construction of the waste strand winding portion is improved to obviate the above-described problem of the prior art.

To this end, according to the present invention, there is provided a glass fiber strand winding apparatus having a rotatable turret and at least two winding collets mounted at one end thereof on said turret, each said collet being provided at the other end with a waste strand winding portion, wherein said strand winding portion is formed with a frusto-conical strand guide surface disposed coaxially with said collet and having the smaller-diameter end thereof on the side remote from said turret, an annular strand stopping wall radially outwardly extending from the smaller-diameter end of said guide surface, a plurality of parallel grooves formed on at least one crescent-shaped wall surface area extending radially inwardly from a portion of the outer periphery at the smaller-diameter end of said guide surface, the grooves extending at a right angle to the diameter of said guide surface, and a crescent-shaped flat portion extending from a portion of the outer periphery of said stopping wall in confronting spaced relationship with said crescent-shaped wall surface area.

The above and other objects, features and advantages of the invention will become clear from the following description of the preferred embodiments taken in conjunction with the accompanying drawings.

Figure 3:
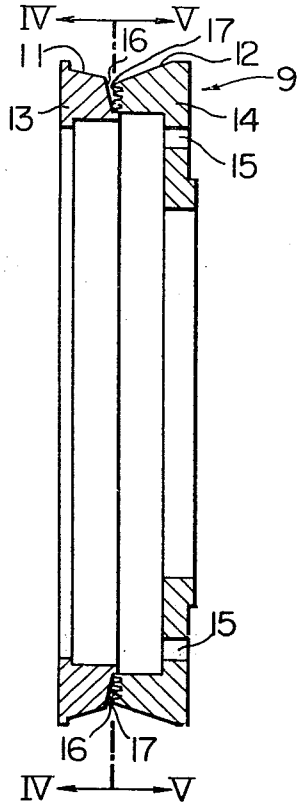
FIG. 3 is a vertical sectional view of an embodiment of the waste strand winding portion of the winding apparatus of the invention.
Figure 7:
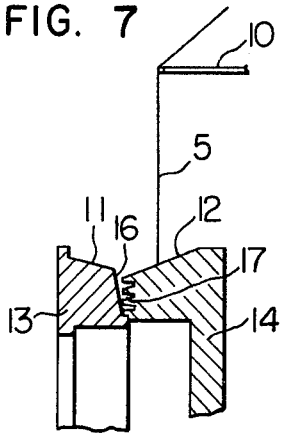
Figure 8:
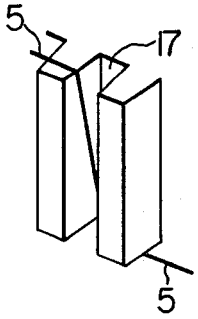
Figure 9:
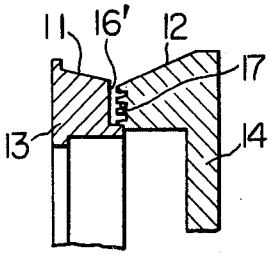

FIGS. *6a*, *6b* and *6c* are schematic illustrations of the operations for transferring of strand from a full winding tube to the waste strand winding portion of the embodiment, gripping of the strand and cutting of the same;

FIG. 7 is a schematic vertical sectional view showing how the strand is guided by the waste strand winding portion shown in FIG. 3;

FIG. 8 is an enlarged perspective view of parallel grooves showing the state in which the strand is trapped and going to be cut by one of the parallel grooves; and FIG. 9 is a schematic vertical sectional view of another embodiment of the waste strand winding portion.

DESCRIPTION OF THE PREFERRED EMBODIMENT

Figure 1:
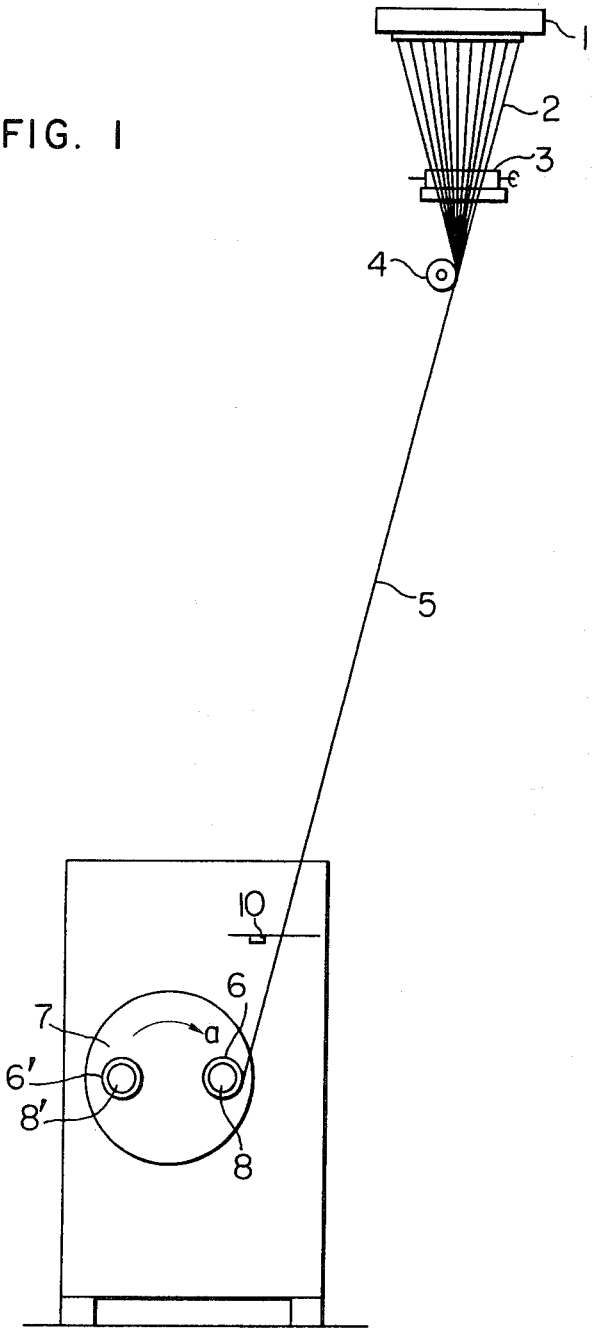
FIG. 1 is a schematic front elevational view of a glass fiber strand winding apparatus of the invention, showing the state for forming the strand package.
Figure 2:
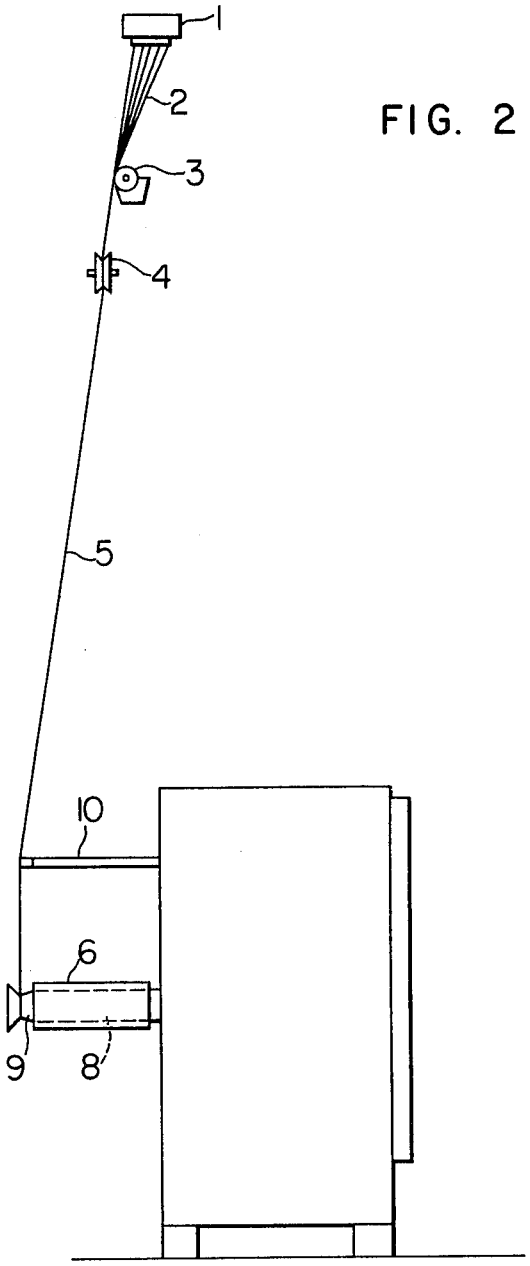
FIG. 2 is a side elevational view of the apparatus shown in FIG. 1.

FIGS. 1 and 2 are schematic illustrations of a glass fiber strand winding apparatus, directly forming a strand package from glass filaments drawn from a bushing. A multiplicity of glass filaments 2 drawn from the bushing 1 are gathered into a single strand 5 through a lubricant size applicator 3 and a gathering roller 4, and is wound on a winding tube 6 to become a package while it is traversed by a traverse motion which is not shown. The winding tube 6 is carried by a winding collet 8 adapted to be rotatively driven and mounted on a rotatable turret 7. The turret 7 carries another winding collet 8' diametrically opposing to the first-mentioned winding collet 8. As the winding tube 6 becomes full, the turret 7 is rotated 180° in the direction of the arrow a to bring the collet 8' carrying an empty winding tube 6' to the winding position. A waste strand winding portion 9 is formed on the free end of each winding collet so that, at the time of start of the winding or when the winding tube has become full, a strand guiding rod 10 is moved ahead to shift the strand 5 to the strand waste strand winding portion 9.

Figure 5:
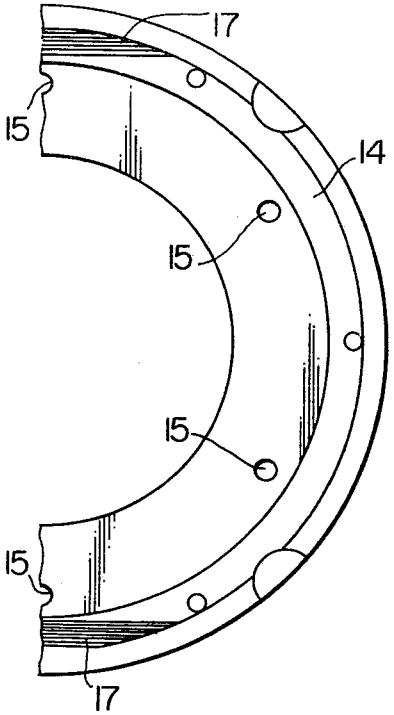
FIGS. 4 and 5 are sectional views taken along the lines IV—IV and V—V of FIG. 3, respectively, showing the halves of respective rings constituting the waste strand winding portion shown in FIG. 3.
Figure 4:
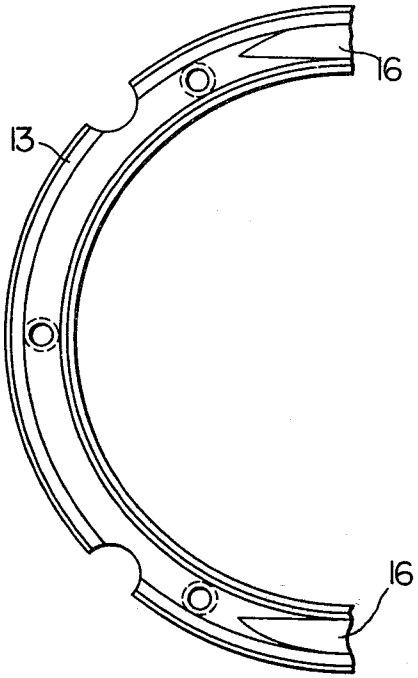

As will be seen from FIG. 3, the waste strand winding portion 9 is composed of a pair of rings 13 and 14 having frusto-conical outer peripheral surfaces 11, 12 and united with each other by means of screws with their smaller-diameter ends abutted against each other. These rings as a unit are fastened to the free end of the winding collet with bolts which penetrate bores 15 formed in the ring 14. The diameter of the smaller-diameter end surface of the ring 13 is slightly greater than the diameter of the smaller-diameter end surface of the ring 14. The portion of the end surface of the ring 13 extending radially outwardly beyond the outer periphery of the end surface of the ring 14 constitutes a stopping surface for stopping the strand which moves towards the smaller diameter end while being guided by the frusto-conical surface 12 of the ring 14 as will be explained later. This end surface of the ring 13 is obliquely cut and removed at two diametrically opposing portions thereof from the outer peripheral edge to a position located radially inside of the outer peripheral edge of the end surface of the ring 14 to present a pair of crescent-shaped flat portions 16 as shown in FIG. 4. As shown in FIG. 5, the end surface of the ring 14 is provided at its two portions confronting the flat portions 16 with a plurality of grooves 17 extending in parallel with one another and at a right angle to the diameter of the ring 14. Although in the described embodiment the waste strand winding portion 9 is composed of a pair of rings 13, 14 coupled with each other, this is not exclusive and the waste strand winding portion 9 may be formed of a single member provided that it is shaped to present the outer peripheral surfaces 11, 12, strand stopping surface, flat portions 16 and the parallel grooves 17 arranged as described above. As will become clear from the description of the effect of the invention which will be taken later, it is not always necessary that the outer peripheral surface 11 of the ring 13 has a frusto-conical shape. Namely, the outer peripheral surface 11 may be a mere cylindrical surface provided that it has a diameter greater than the diameter of the smaller-diameter end of the outer peripheral surface 12 of the ring 14.

The waste strand winding portion having the described construction operates in a manner explained hereinunder.

Figure 6A:
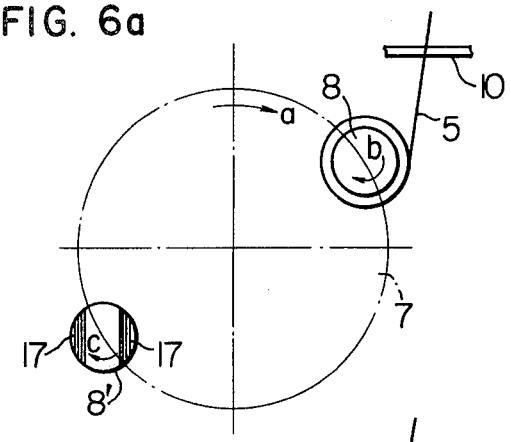
Figure 6B:
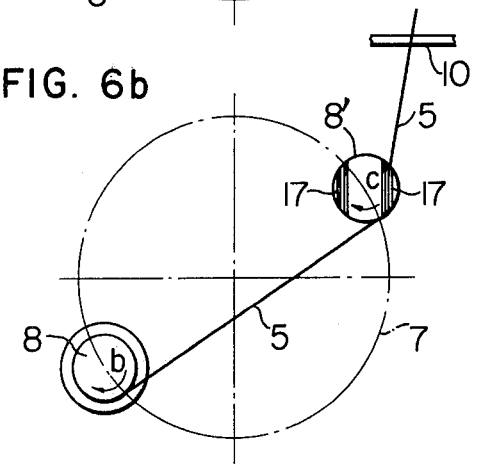
Figure 6C:
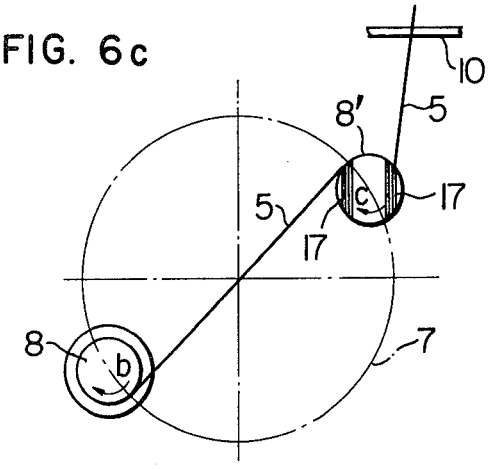

Referring first to FIG. 6*a*, the winding collet 8 placed at the winding position on the turret 7 is rotated in the direction of the arrow b so that the glass fiber strand 5 is wound around the winding tube 6 carried by the collet 8. As the winding tube 6 becomes full, the strand guide rod 10 (See FIGS. 1 and 2) is moved ahead to shift the waste strand 5 from the winding tube 6 to the waste strand winding portion 9. Then, the turret 7 is rotated 180° in the direction of the arrow a so that the other winding collet 8', which carrys an empty winding tube 6 and rotates in the direction of the arrow c, is brought to the winding position, as will be seen from FIG. 6*b*. As shown in FIG. 7, as a result, the strand 5 is made to contact with the outer peripheral surface 12 of the ring 14 of the waste strand winding portion 9 of the winding collet 8', and is shifted along the outer peripheral surface 12 towards the smaller-diameter end by the action of the tensile force exerted by the full collet 8, and finally reaches the strand stopping surface presented by the end surface of the ring 13. Then, as one of the crescent-shaped oblique flat portions 16 (See FIG. 4) formed in the end surface of the ring 13 is turned to the position of the strand 5, the latter slides down along the oblique flat portion 16 to be dropped into and caught by one of the parallel grooves 17 (See FIG. 5) formed in the end surface of the ring 14. Then, as the winding collet 8 and the winding collet 8' are rotated continuously in the directions of the arrows b and c, respectively, the strand 5 is dropped into one of the parallel grooves of another group as shown in FIG. 6*c*. Then, as the winding collets are further rotated in respective directions, the tension applied to the strand 5 stretched between both collets in increased. Partly because of this increased tension and partly because of a keen bend presented by the edge of the groove 17 as shown in FIG. 8, the strand 5 is cut at the point contacting the edge of the groove 17. The portion of the strand 5 remaining on the waste strand winding portion 9 of the winding collet 8' carrying the empty winding tube is extended over the groove 17 of the first group and the groove 17 of the second group via a part of the outer peripheral surface 12 of the ring 14 and is firmly held so that the waste strand winding portion 9 starts to wind the strand 5. Then, as the winding collet 8' is accelerated to a predetermined speed to provide a predetermined filament diameter, the strand guiding rod 10 is retracted to shift the strand 5 onto the empty winding tube 6' so that the normal winding operation is started.

As stated before, the glass fiber winding apparatus disclosed in the specification of the U.S. Pat. No. 4,046,329 has suffered a problem of winding failure due to small friction of the strand attributable to a small length of contact of the strand with the fixed member because the strand is trapped and cut only at one point thereof by the fixed member such as pin, hook or the guide plate. This winding failure takes place often particularly when the strand has filaments of a small diameter formed under a large winding tension. This problem, however, is completely overcome by the present invention because the strand is trapped over a substantial length thereof by one of the parallel grooves to produce a friction which is sufficiently large to hold the strand without fail. In addition, the undesirable local wear of the strand gripping portion is avoided to prolong the life time of the apparatus. Moreover, even if the lubricant size adhered to the strand is accumulated in one of the parallel grooves after a long operation, other parallel grooves can effectively trap the strand so that the apparatus can operate long without requiring frequent suspension of operation for cleaning.

Although the invention has been described through specific terms, the described embodiment is not exclusive and various changes and modifications may be made thereto within the scope of the invention.

For instance, FIG. 9 shows another embodiment in which the crescent-shaped flat portion on the ring 13 is formed in parallel with the end surface of the ring 14 as denoted at 16', in contrast to the embodiment shown in FIGS. 1, 2 and 7 in which the crescent-shaped flat portion 16 is inclined. In the embodiment shown in FIG. 9, however, it is necessary to reduce as much as possible the distance between the flat portion 16' and the end surface on which the parallel grooves 17 are formed. The parallel grooves 17 are preferably formed in two groups at two positions in symmetry with respect to the center of the ring 14, although the invention does not exclude formation of the two groups of parallel grooves 17 at assymetrical positions or to form three groups or even one group of parallel grooves.

Other changes and modifications are possible without departing from the scope and spirit of the invention which is limited solely by the appended claims.

What is claimed is:

1. A glass fiber strand winding apparatus having a rotatable turret and at least two winding collets mounted at one end thereof on said turret, each said collet being provided at the other end with a waste strand winding portion, wherein said waste strand winding portion is formed with a frusto-conical strand guide surface disposed coaxially with said collet and having the smaller-diameter end thereof on the side remote from said turret, an annular strand stopping wall radially outwardly extending from the smaller-diameter end of said guide surface, a plurality of parallel grooves formed on at least one crescent-shaped wall surface area extending radially inwardly from a portion of the outer periphery at the smaller-diameter end of said guide surface, the grooves extending at a right angle to the diameter of said guide surface, and a crescent-shaped flat portion extending from a portion of the outer periphery of said stopping wall in confronting spaced relationship with said crescent-shaped wall surface area.

2. A glass fiber strand winding apparatus as claimed in claim 1, wherein said crescent-shaped flat portion is inclined radially inwardly to gradually approach said crescent-shaped wall surface.

3. A glass-fiber strand winding apparatus as claimed in claim 1, wherein the said crescent-shaped flat portion extends in parallel with said crescent-shaped wall surface.

4. A glass fiber strand winding apparatus as claimed in claim 1, wherein said waste strand winding portion is composed of a first ring having a frusto-conical outer peripheral surface and attached at the larger-diameter end thereof to the other end of said collet coaxially therewith and a second ring having a frusto-conical outer peripheral surface with a smaller-diameter end of a diameter larger than that of the smaller-diameter end of said first ring and forming said annular stopping wall and coaxially coupled at the smaller-diameter end thereof to the smaller-diameter end of said first ring and wherein said parallel grooves are formed on the smaller-diameter end surface of said first ring and said crescent-shaped flat portion is formed on the smaller-diameter end surface of said second ring.

5. A glass fiber strand winding apparatus as claimed in any one of claims 1, 2, 3 and 4, wherein two sets of said parallel grooves and said crescent-shaped flat portion are formed in diametrically opposed positions.

* * * * *